US011141003B1

(12) United States Patent
Schumaker

(10) Patent No.: US 11,141,003 B1
(45) Date of Patent: Oct. 12, 2021

(54) BABY CARRIER AND BACKPACK SYSTEM AND METHOD OF USE

(71) Applicant: Robert J. Schumaker, Larchmont, NY (US)

(72) Inventor: Robert J. Schumaker, Larchmont, NY (US)

( * ) Notice: Subject to any disclaimer, the term of this patent is extended or adjusted under 35 U.S.C. 154(b) by 0 days.

(21) Appl. No.: 16/850,814

(22) Filed: Apr. 16, 2020

Related U.S. Application Data

(60) Provisional application No. 62/835,194, filed on Apr. 17, 2019.

(51) Int. Cl.
*A47D 13/02* (2006.01)
*A45F 3/04* (2006.01)

(52) U.S. Cl.
CPC ..... *A47D 13/025* (2013.01); *A45F 3/04* (2013.01); *A45F 2003/045* (2013.01)

(58) Field of Classification Search
CPC ..... A47D 13/025; A47D 13/02; A45F 3/04; A45F 3/14; A45F 2003/003; A45F 4/02; A45C 9/00
USPC ..... 224/158–160, 646–647, 153
See application file for complete search history.

(56) References Cited

U.S. PATENT DOCUMENTS

| | | | | |
|---|---|---|---|---|
| 5,603,441 | A * | 2/1997 | Easter | A45F 3/00 224/153 |
| 8,622,263 | B2 * | 1/2014 | Su | A45C 7/0045 224/153 |
| 9,504,337 | B2 * | 11/2016 | Workman | A47D 13/025 |
| 9,521,912 | B2 * | 12/2016 | Yen | A47D 13/025 |
| 10,076,194 | B2 * | 9/2018 | Wikner | A47D 13/025 |
| 2006/0261104 | A1 * | 11/2006 | Zambrzycki | A47D 13/025 224/158 |
| 2019/0328118 | A1 * | 10/2019 | Robinson | A47D 13/025 |
| 2020/0085175 | A1 * | 3/2020 | Cotirla | A45F 4/02 |
| 2020/0113350 | A1 * | 4/2020 | Warner | A45F 3/04 |
| 2020/0337475 | A1 * | 10/2020 | Musiiwa | A47D 13/025 |
| 2021/0093098 | A1 * | 4/2021 | Ross | A45F 4/02 |

* cited by examiner

*Primary Examiner* — Adam J Waggenspack
(74) *Attorney, Agent, or Firm* — Leavitt Eldredge Law Firm

(57) ABSTRACT

A baby carrier and backpack system that allows for the convenient carrying of baby or child in a carrier that is attached to a backpack. The backpack supports the straps and buckles to hold the baby on the adult's chest. The backpack also carries the items such as diapers, wipes, toys, treats and the like as need to care for the baby.

2 Claims, 8 Drawing Sheets

BABY CARRIER AND BACKPACK SYSTEM AND METHOD OF USE

BACKGROUND

1. Field of the Invention

The present invention relates generally to baby carriers and backpacks, and more specifically, to a backpack that includes a detachable front-side baby carrier, thereby providing for a system that can be easily and conveniently used as a backpack and/or a baby carrier and further includes a convenient carry system for diapers, wipes and other baby essentials, and further includes a cooler apparatus.

2. Description of Related Art

A variety of diaper bags and infant carriers currently exist. Common diaper bags include handles and/or a shoulder strap that enables the bag to be carried over the shoulder or across the shoulder as an infant is held in the adult's arms. When carrying an infant long distance or over a long duration, such as in a park or in a retail store, it is common to place the infant in a carrier to assist the parent or guardian as they walk with the infant or small child. There are a variety of carrier styles that provide several modes of carrying an infant or small child including in the front, on the hip, in a reclined position, or on the back of an adult.

It is common to witness parents or caregivers juggle both a diaper bag and a carrier while getting tangled in multiple straps as they try to provide on-the-go care for their infant or small child. Alternatively, it is also common to see parents or caregivers wear a front-side baby carrier and wear their backpack over and in addition to the support system on their back. However, once the child decides they don't want to be in the carrier, there is nowhere to store the support system and carrier. These two-piece systems are often large and bulky and don't easily fit in a backpack; especially with all the other childcare items stored in the backpack. The result is that many parents will either forgo the carrier or the diaper bag to simplify their journey outside the home. However, this is not an effective solution.

Infants and small children are 'high maintenance' and leaving a diaper bag behind may result in ending an outing sooner than anticipated. For example, if a child requires a new diaper, change of clothes, food, a favorite toy, or the like and they are not on hand, the trip must end or become substantially less productive or enjoyable.

On the other hand, deciding to forgo or forgetting to bring a carrier can make it difficult to make a stops where the child must exit the vehicle such as a trip to the mall, a bookstore, a stroll on a beach or park because carrying an infant or small child is stressful on the back and arms without the assistance of a carrier. The situation is also problematic when a stroller is not practical such as on stairs, buses, airplanes, escalators and the like.

Transporting an infant outside the home, often requires the parent or caregiver to bring along numerous items. These include items such as diapers, a changing pad, wipes, extra clothes, food, and toys in addition to essential parent's or caregiver's valuables such as a wallet, keys, a cell phone, and the like. Trying to fit most of the child's and adult's belongings into a small pouch or pocket is impractical and at best inconvenient. Carrying an additional diaper bag for those items can also be inconvenient and cumbersome.

Furthermore, toddlers often wish to practice their newly acquired walking skills so a carrier device is not always needed, yet, the convenience of having a carrier at one's fingertips is extremely useful.

What is needed is a diaper bag in the form of a backpack that can act as the support system to a front side soft infant carrier when needed.

Accordingly, although great strides have been made in the area of baby carries and backpack, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
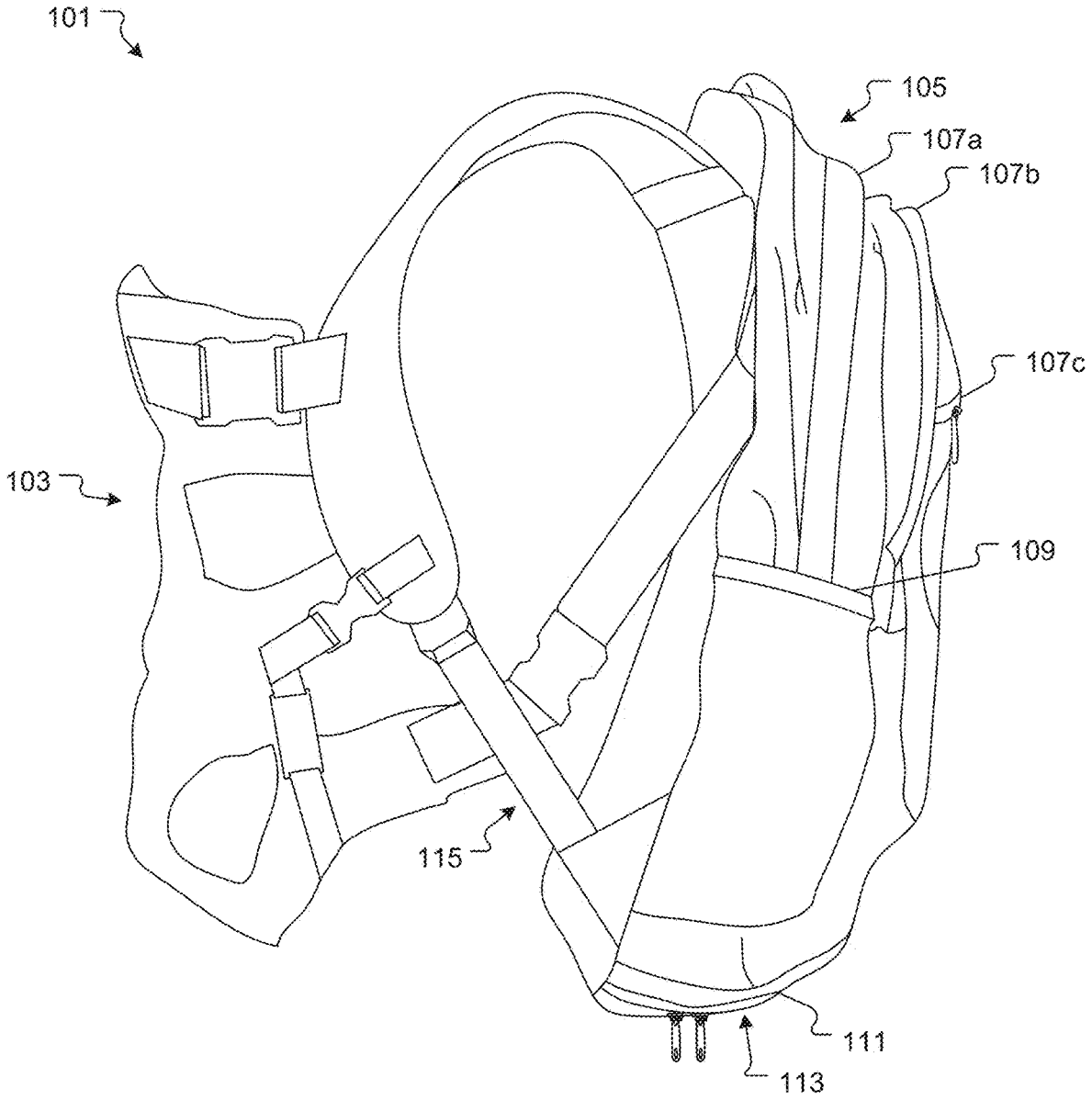
FIG. 1 is a side view of a baby carrier and backpack system in accordance with a preferred embodiment of the present application.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional baby carriers and backpacks. Specifically, the present invention uses one device to provide means of carrying an infant or small child on the chest of a caregiver while also carrying the items needed to care for such on the back of the caregiver. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Referring now to the drawings wherein like reference characters identify corresponding or similar elements throughout the several views, FIG. 1 depicts a side view of a baby carrier and backpack system in accordance with a preferred embodiment of the present application. It will be appreciated that system 101 overcomes one or more of the above-listed problems commonly associated with conventional baby carriers and backpacks.

In the contemplated embodiment, system 101 includes a front-side child carrier 103 removably attached to a backpack 105 via a harness 115. The backpack 105 includes pockets 107 that are configured to hold and store items that are used to care for an infant or a small child. Further, the backpack 105 includes compartments 109 that also store or hold items. The backpack 105 also includes an insulated compartment 111 near the bottom 113 thereof.

It is contemplated that the backpack 105 be used for a variety of activities, including hiking and the like, wherein a detachable front-side baby carrier can attach to the backpack and be removed for the user's convenience. This feature provides for a user to have both a backpack and a front-side baby carrier, instead of conventional systems that require the user to utilize two separate apparatuses at the same time.

It is contemplated that the system could include features such as water-resistant zippers ripstop nylon or other features that improve the ability of the system to carry a child and the items needed to care therefor.

It should be appreciated that one of the unique features believed characteristic of the present application is that the harness 115 allows the use of the front-side child carrier 103 without extra equipment and that the backpack provides the support for the harness 115 and the carrier 103 while storing the items needed to care of the child.

It will be understood that the backpack 105 is configured to carry items or objects in the pockets 107 and compartments 109 thereof. It will, therefore, be understood that the backpack 105 will have a back, a front and side walls or panels so to form. It is not the intent of this disclosure to redefine a backpack but to demonstrate the novel ability to support a front-side child carrier thereon.

Figure 2:
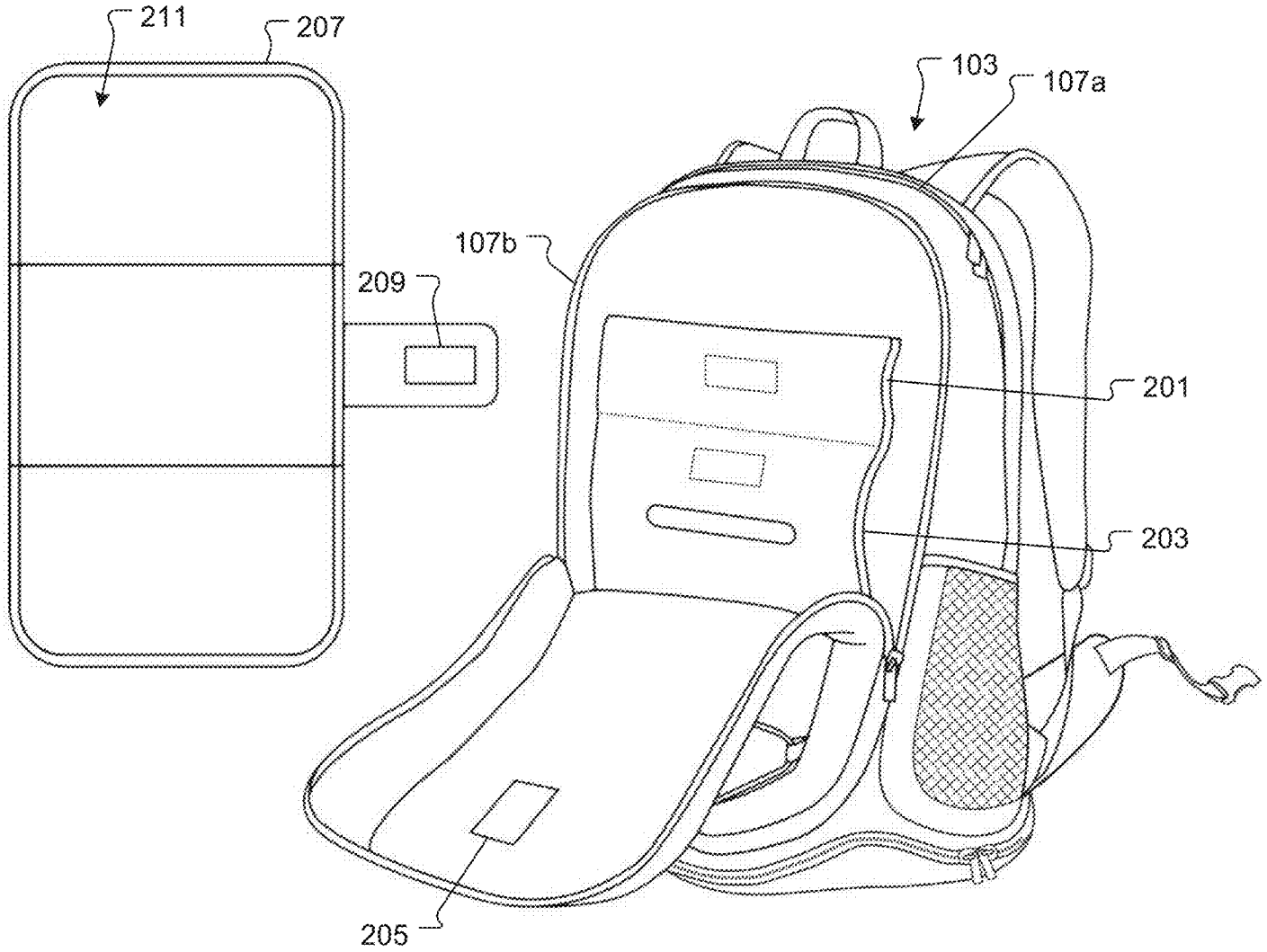
FIG. 2 is a front isometric view of the backpack of FIG. 1

Referring now to FIG. 2 the backpack 105 is opened to depict another novel feature of the invention. When the pocket 107 opens to reveal a first compartment 201 that stores cream or another topical ointment and a second compartment 203 that dispenses wipes. At the bottom of the pocket 107 is a space to store diapers. The interior of the pocket 107 includes an attachment point 205 that allows a mat 207 to attach thereto. The mat 207 has a matching attachment point 209 that is configured to hold the mat 207 to the backpack 105. It is contemplated that the mat 207 includes a waterproof surface 211. It is contemplated that the mat 207 is configured to fold and store in the pocket 107.

It will be appreciated that mat 207 with the first compartment 201 and second compartment 203 provide a convenient place to change the baby. It is contemplated that any item or method of changing a baby could be incorporated in the backpack 105 and its pockets 107.

Figure 3:
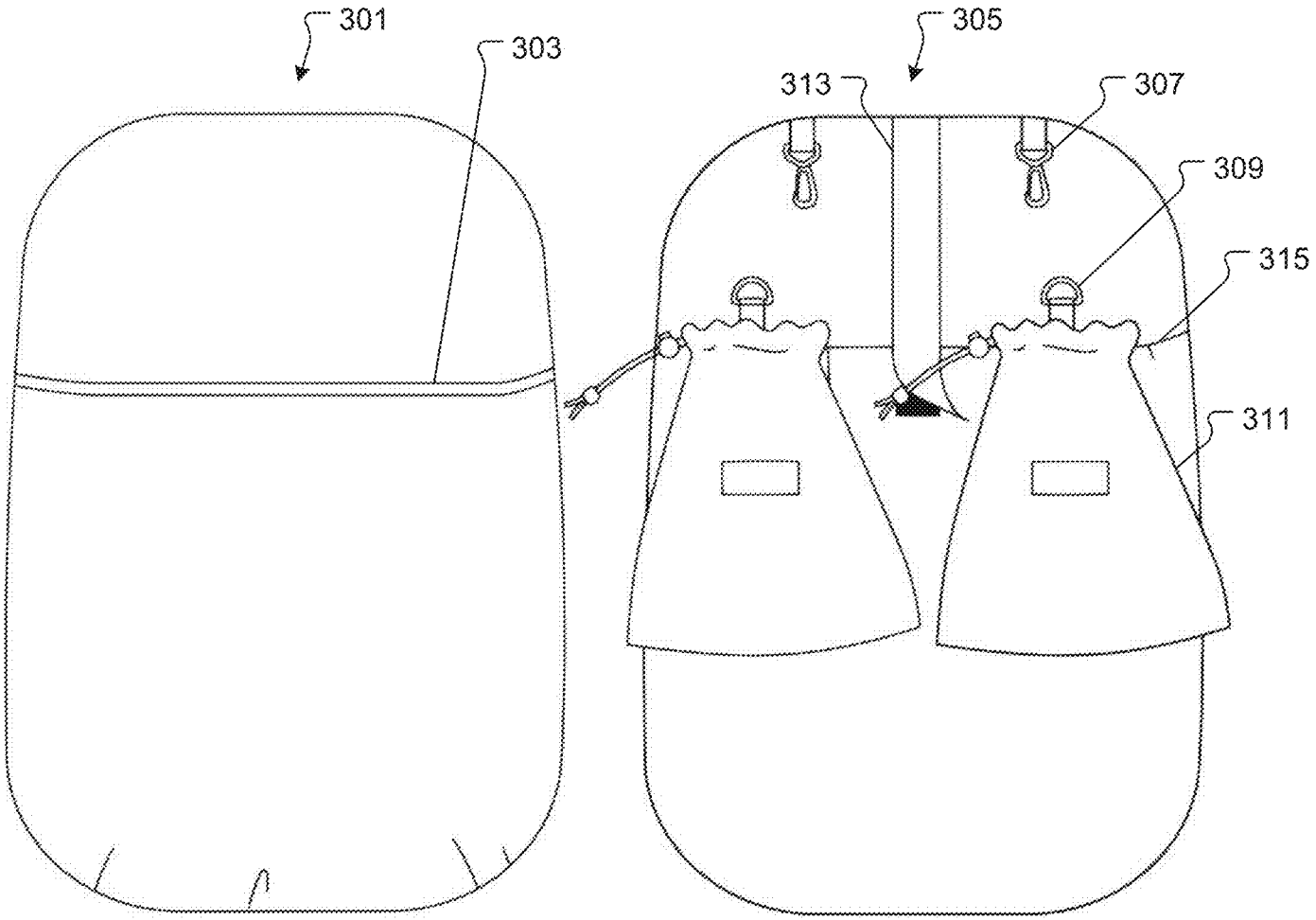
FIG. 3 is a front view of alternative embodiments of the interior of the pockets of the backpack of FIG. 1.

FIG. 3 depicts alternative embodiments of the interior pockets 107 of the backpack. Embodiment 301 includes a compartment 303 with elastic binding that allows for storage where embodiment 305 includes hooks 307 and loops 309 that could hold hanging items such as bags 311. It is contemplated that straps 313 could also be used to close or secure pouch 315.

Figure 4:
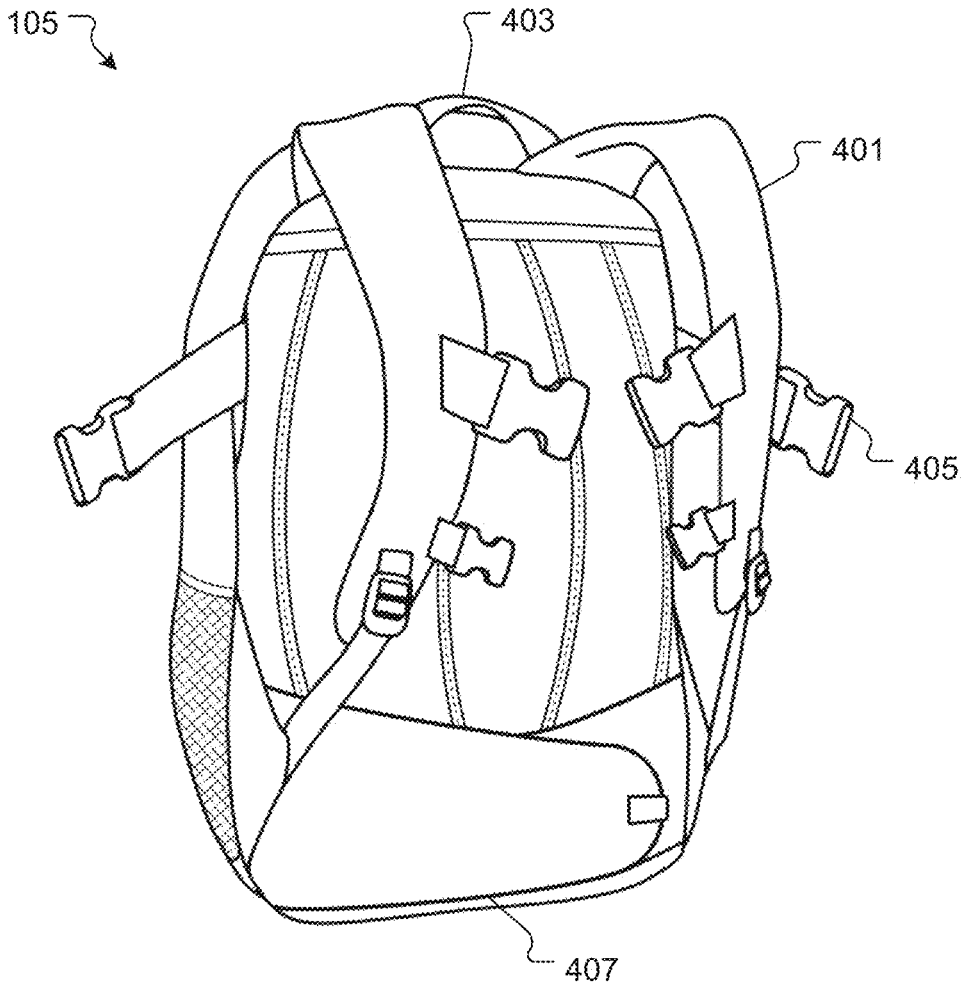
FIG. 4 is a back-isometric view of the backpack of FIG. 1.

Referring now to FIG. 4 the backpack 105 is further depicted without the front-side child carrier 103. The backpack 105 includes straps 401 that hold the pack to a user. The backpack also has buckles 405 that allow for straps or other parts of the harness 115 or carrier 103 to attach to the backpack 105. It is further contemplated that the backpack 105 could have handles 403, waist straps 407, chest strap and the like to accommodate the carrying or movement of thereof.

Figure 5A:
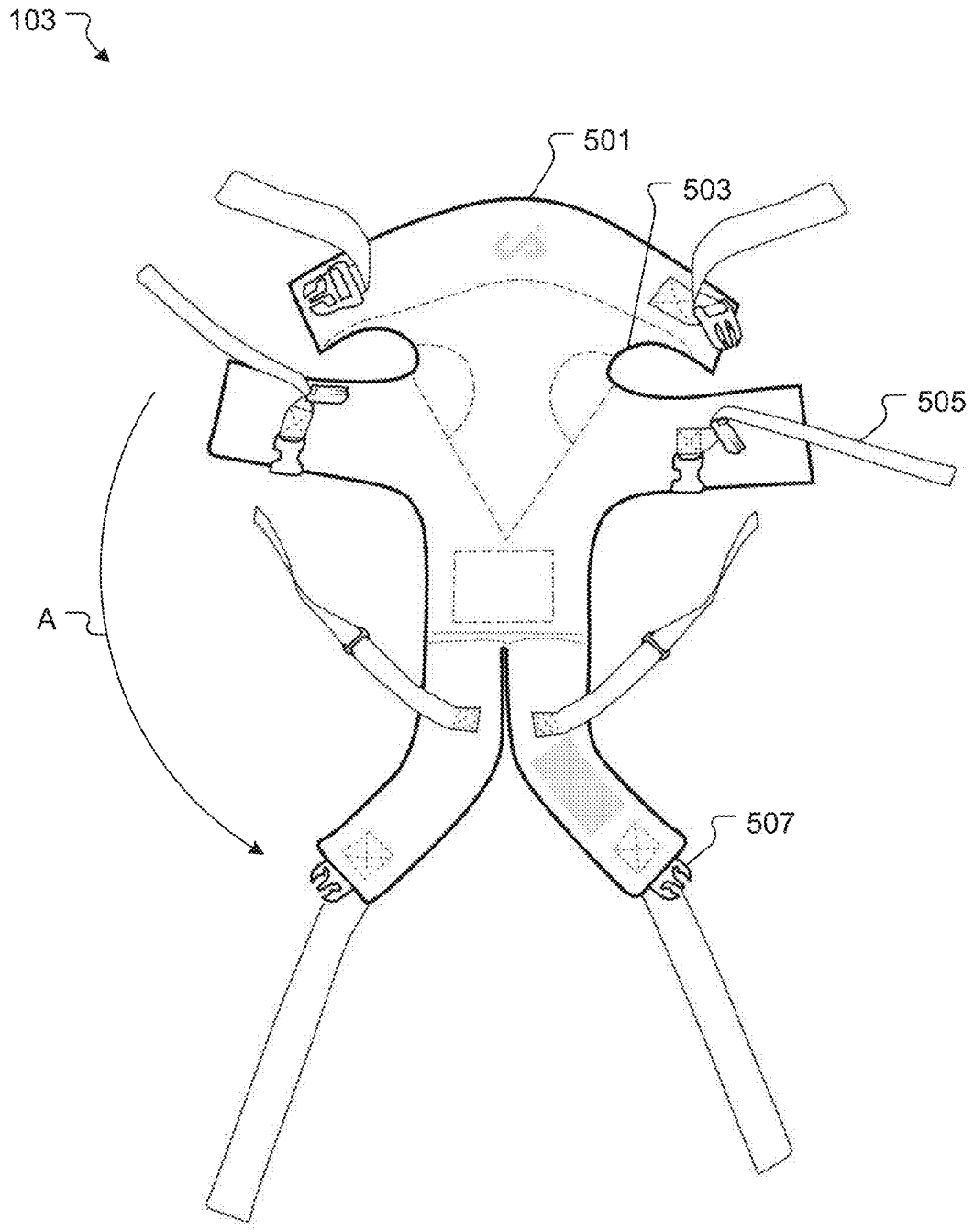
FIGS. 5A and 5B are a front view and a side view respectively of the child carrier of FIG. 1.
Figure 5B:
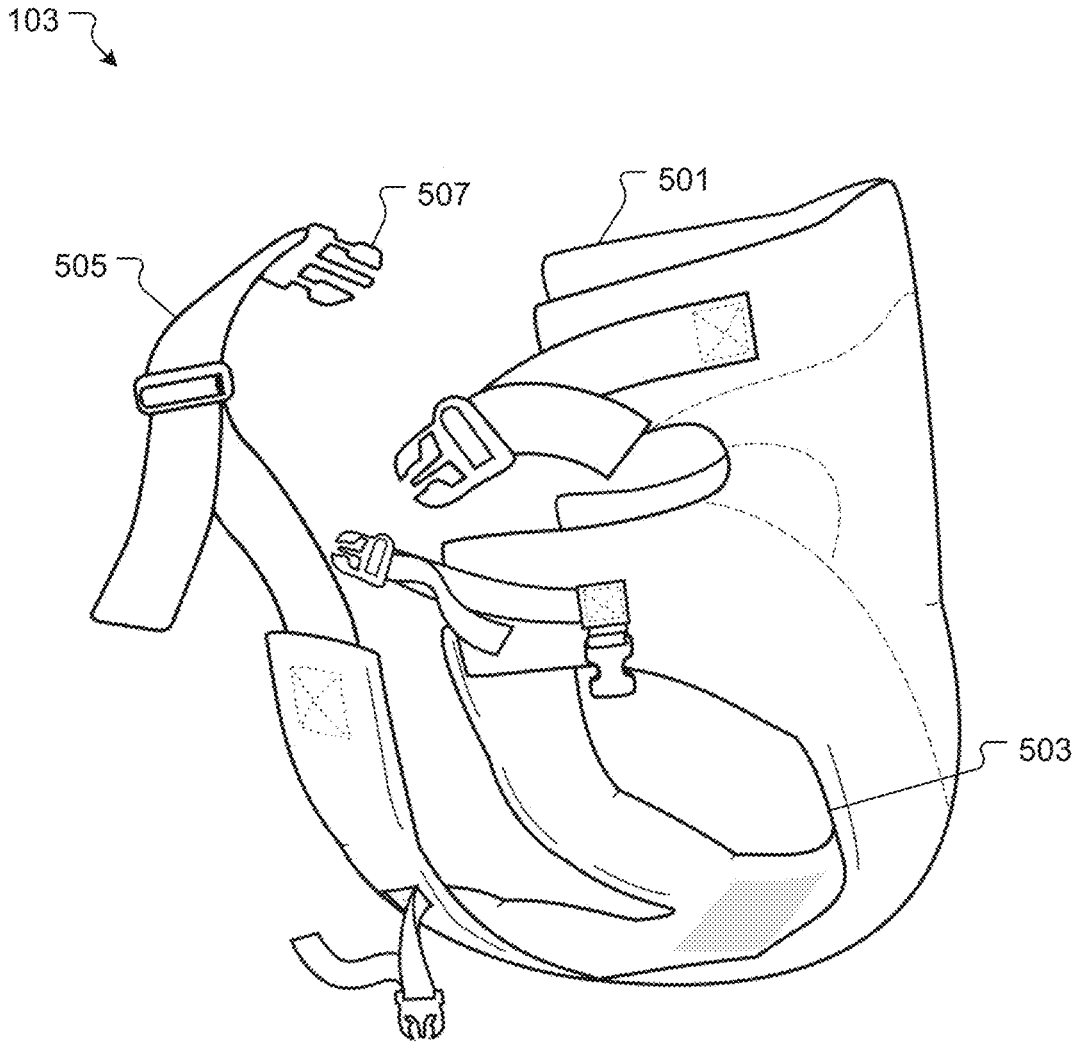

The front-side child carrier 103 is further depicted removed from the backpack 105 in FIGS. 5A and 5B. The carrier 103 includes pads 501 and cutouts 503 that are configured to comfortably hold the child in a variety of positions, such as facing in, facing out or the like. The cutouts 503 are intended to accommodate the appendages of the child. The carrier 103 also includes straps 505 and buckles 507 that arrange the pads 501 such as tightening. The straps 505 and buckles 507 attach the carrier to the backpack 105 or harness 115. The carrier 103 folds or gathers together as depicted by motion A to form the place where the child is carried.

Figure 6:
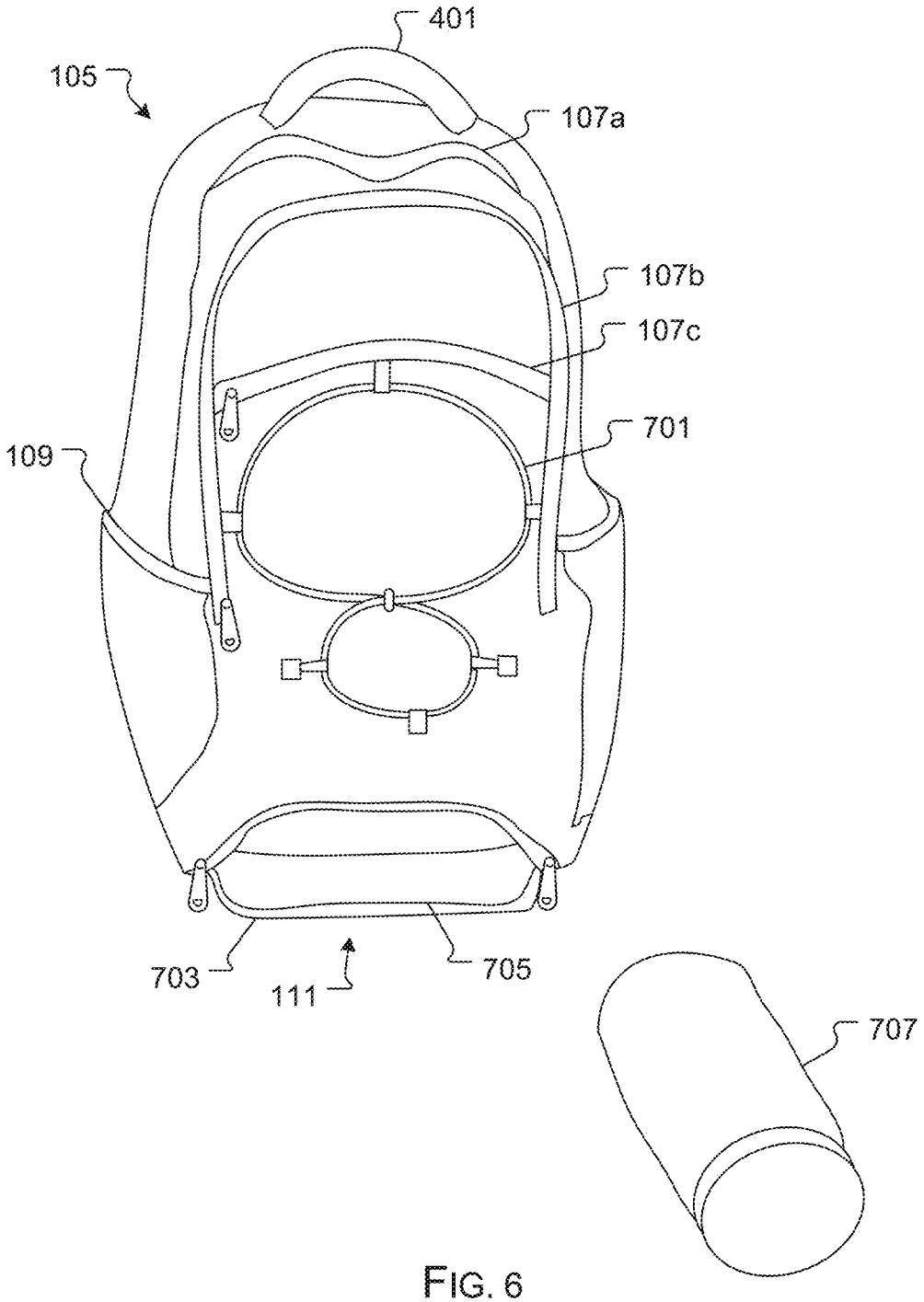
FIG. 6 is a front view of the backpack of FIG. 1.

Referring now to FIG. 6 the backpack is depicted with the insulated compartment 111 open. It is contemplated that the insulated compartment 111 includes an opening 703 to a waterproof space 705. It will be understood that food or drinks for the child or the adult are stored in an insulated container 707 as well. It is also contemplated that a web 701 could be used on the outside of the backpack to further increase the carrying capacity of the backpack 105.

It is contemplated that the system could be used to hold or store items for the adult or caregiver as well as the child. For example, padded laptop pockets, clips, straps, bags, and the like.

Figure 7:
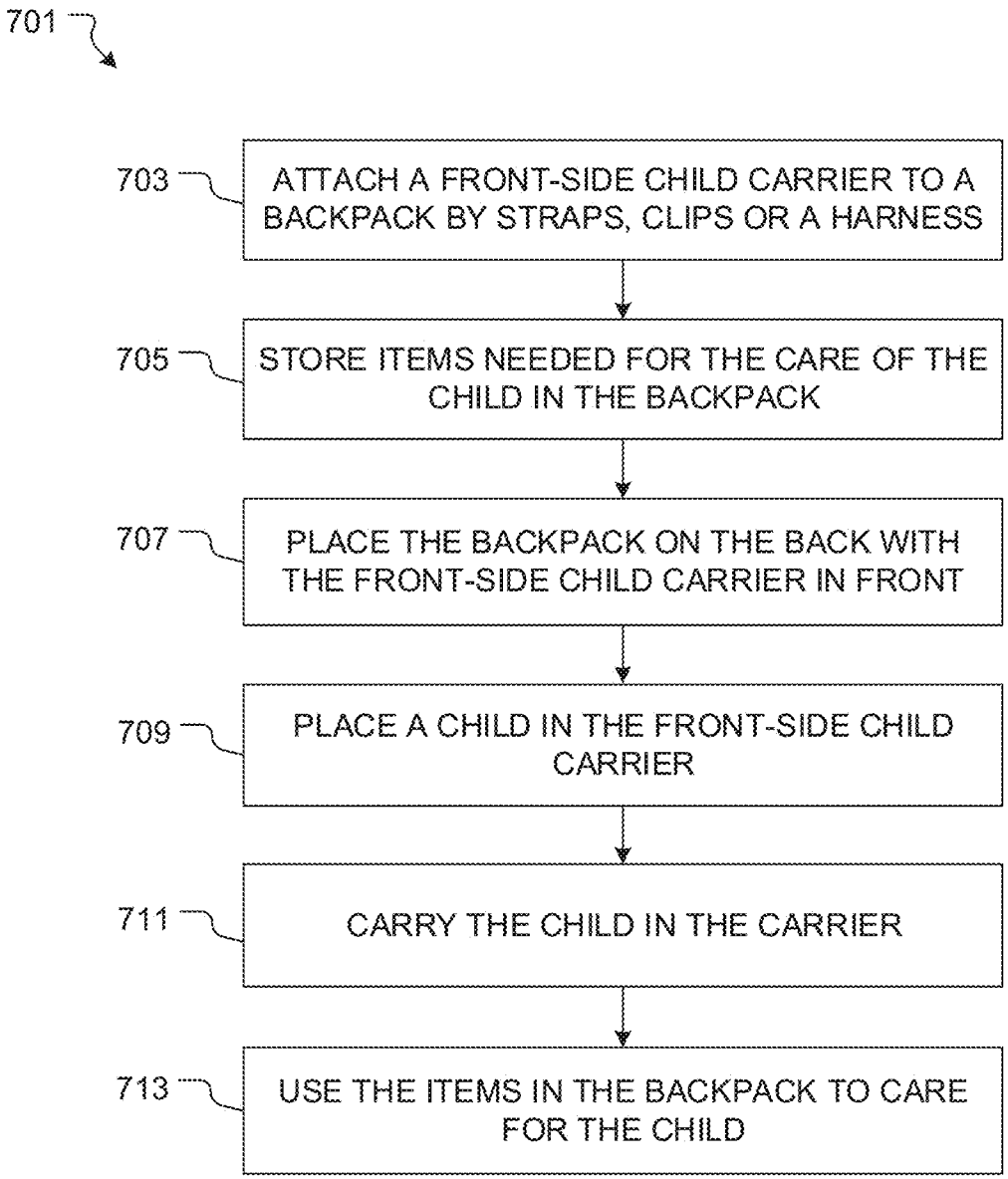
FIG. 7 is a flowchart of a method of carrying a child and items for its care.

Referring now to FIG. 7 a method of carrying and caring for a child is depicted. Method 7 includes attaching a front-side child carrier to a backpack by straps, clips or a harness 703, storing items needed for the care of the child in the backpack 705, placing the backpack on the back with the front-side child carrier in front 707, placing a child in the front-side child carrier 709, carrying the child in the carrier 711 and using the items in the backpack to care for the child 713.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed:

1. A baby carrier and backpack system comprising:

at least one backpack; and the backpack including:

a back panel, an outside panel, side panels, at least one pocket, and a first strap and a second strap each extending from a top section of the backpack and including fasteners; and two shoulder straps attached at each of their ends to the backpack and including four fasteners along the length thereof;

a front-side child-carrying pouch, having:

a body with six arms extending therefrom, each of the six arms having a fastener engaged respectively with one of the fasteners of the two shoulder straps, the first strap and the second strap.

2. The system of claim 1 wherein the backpack further includes a waist strap or chest strap.

* * * * *